US008925772B2

(12) United States Patent
Vukovics

(10) Patent No.: US 8,925,772 B2
(45) Date of Patent: Jan. 6, 2015

(54) INFANT CARRIER

(71) Applicant: Stacey Vukovics, St. Catharines (CA)

(72) Inventor: Stacey Vukovics, St. Catharines (CA)

( * ) Notice: Subject to any disclaimer, the term of this patent is extended or adjusted under 35 U.S.C. 154(b) by 0 days.

(21) Appl. No.: 14/102,254

(22) Filed: Dec. 10, 2013

(65) Prior Publication Data

US 2014/0166705 A1 Jun. 19, 2014

Related U.S. Application Data

(60) Provisional application No. 61/738,689, filed on Dec. 18, 2012.

(51) Int. Cl.
*A47D 13/02* (2006.01)

(52) U.S. Cl.
CPC ..... *A47D 13/02* (2013.01)
USPC ..... 224/160

(58) Field of Classification Search
CPC ..... A47D 13/02; A47D 13/025
USPC ..... 224/158, 159, 160
See application file for complete search history.

(56) References Cited

U.S. PATENT DOCUMENTS

| | | | | | |
|---|---|---|---|---|---|
| 1,518,830 | A | * | 12/1924 | Woods | 224/160 |
| D672,546 | S | * | 12/2012 | Dror et al. | D3/214 |
| D695,513 | S | * | 12/2013 | Jackson | D3/213 |
| 2004/0112302 | A1 | * | 6/2004 | Guynn | 119/770 |
| 2007/0278264 | A1 | * | 12/2007 | Chesal et al. | 224/160 |
| 2012/0248159 | A1 | * | 10/2012 | Rahni | 224/158 |
| 2012/0286002 | A1 | * | 11/2012 | Dardel et al. | 224/159 |
| 2013/0298844 | A1 | * | 11/2013 | Wernick et al. | 119/712 |
| 2013/0299532 | A1 | * | 11/2013 | Jacobs | 224/158 |
| 2014/0166705 | A1 | * | 6/2014 | Vukovics | 224/158 |
| 2014/0224846 | A1 | * | 8/2014 | Mullins | 224/159 |
| 2014/0231472 | A1 | * | 8/2014 | Cha | 224/160 |
| 2014/0231473 | A1 | * | 8/2014 | Bailey et al. | 224/160 |

* cited by examiner

*Primary Examiner* — Justin Larson

(57) ABSTRACT

An infant carrier comprises three interconnected loops of fabric, the three interconnected loops comprising a first loop, a second loop and a third loop. The first and second loops are each configured for being worn over a respective shoulder of a wearer, and the third loop is configured for being worn about the waist of the wearer. The first, second and third loops cooperate to support an infant when worn by the wearer.

10 Claims, 5 Drawing Sheets

INFANT CARRIER

CROSS-REFERENCE TO RELATED APPLICATION

This application claims the benefit of provisional U.S. Application No. 61/738,689 filed on Dec. 18, 2012, the content of which is incorporated herein by reference in its entirety.

FIELD OF THE INVENTION

The present invention relates generally to article carriers and in particular, to an infant carrier.

BACKGROUND OF THE INVENTION

Wearable infant carriers that allow a person to comfortably wear the carrier and safely carry an infant therein in a "hands free" manner are known.

Several different kinds of infant carriers have been described. For example, one popular kind of infant carrier includes a seat or "pouch" for supporting an infant on the chest or the back of the wearer, and further includes an arrangement of fasteners attached to the pouch for securing the infant therein. The fasteners typically comprise one or more straps, belts, rings, buckles and/or clips. As will be understood, such fasteners or other mechanisms can break and result in failure of the infant carrier during use. Additionally, such fasteners or other mechanisms are typically not replaceable and, in the event that the fasteners do break, the entire infant carrier typically needs to be replaced.

Another kind of known infant carrier is the wrap-type infant carrier, or "wrap", which comprises a long, rectangular piece of fabric that is wrapped and tied around both a wearer and an infant for supporting an infant inserted therein. However, wraps are often time consuming and tedious to don by the wearer, and typically require use of both of the wearer's hands to wrap and tie the wrap prior to inserting the infant therein. As a result, another individual is typically required to hold the infant while the wearer dons the wrap.

Improvements are generally desired. It is therefore an object of the present invention at least to provide a novel infant carrier.

SUMMARY OF THE INVENTION

Accordingly, in one aspect there is provided an infant carrier comprising: three interconnected loops of fabric, the three interconnected loops comprising a first loop, a second loop and a third loop, the first and second loops each being configured for being worn over a respective shoulder of a wearer, the third loop being configured for being worn about the waist of the wearer, the first, second and third loops cooperating to support an infant when worn by the wearer.

In one embodiment, the infant carrier is fabricated entirely of the fabric, and is devoid of any fastener.

The third loop may be shorter in length than the first loop and the second loop.

At least one of the loops may be fabricated from a rectangular piece of the fabric having stitched transverse edges.

The infant carrier may further comprise at least one pocket on one or more of the first, second and third loops.

The first, second and third loops may cooperate to provide a five-point harness for supporting the infant when worn by the wearer.

The infant carrier may be adjustable to size by twisting one or more of the first, second and third loops.

Each of the three interconnected loops may be connected to each of the other two loops in an interlocking manner.

The fabric may be a knit fabric.

BRIEF DESCRIPTION OF THE DRAWINGS

Embodiments will now be described more fully with reference to the accompanying drawings in which.

DETAILED DESCRIPTION OF THE EMBODIMENTS

Figure 1:
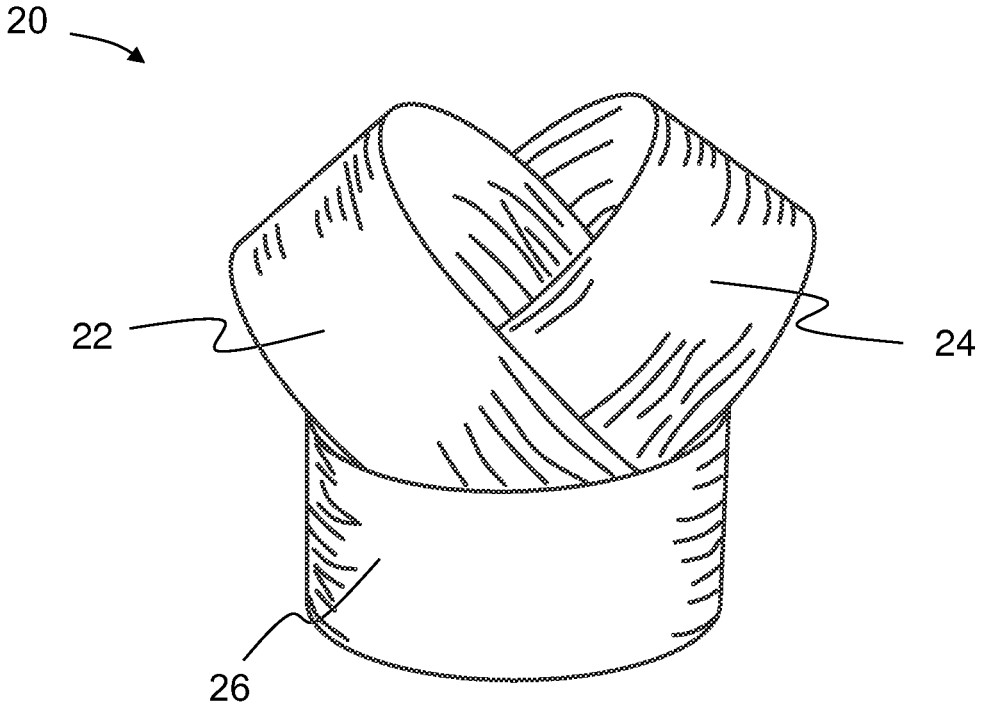
FIG. 1 is a front view of an infant carrier.

Turning now to FIGS. 1 to 9, an infant carrier is shown and is generally indicated by reference numeral 20. Infant carrier 20 comprises three (3) interconnected loops of fabric that cooperate to support an infant when worn by a wearer. It will be understood that herein an infant refers to any of a baby, a toddler, a small child, and the like, and in this embodiment the infant carrier 20 is capable of supporting infants having a weight of about 5 lbs to about 35 lbs. The infant carrier 20 advantageously does not comprise any fasteners, such as for example buckles, straps, rings or belts, and is fabricated entirely of the fabric.

The infant carrier 20 comprises a first loop 22, a second loop 24 and a third loop 26, all of which are interconnected. As will be understood, each of the three (3) interconnected loops 22, 24 and 26 is connected to each of the other two (2) loops in an interlocking manner, as may be seen in FIGS. 1 and 3. The first and second loops 22 and 24 are configured to be worn over the shoulders of a wearer, while the third loop 26 is configured to be worn about the waist of the wearer. In this embodiment, the first and second loops 22 and 24 have the same circumferential length, while the third loop 26 has a shorter circumferential length than each of the first and second loops 22 and 24.

Figure 2A:
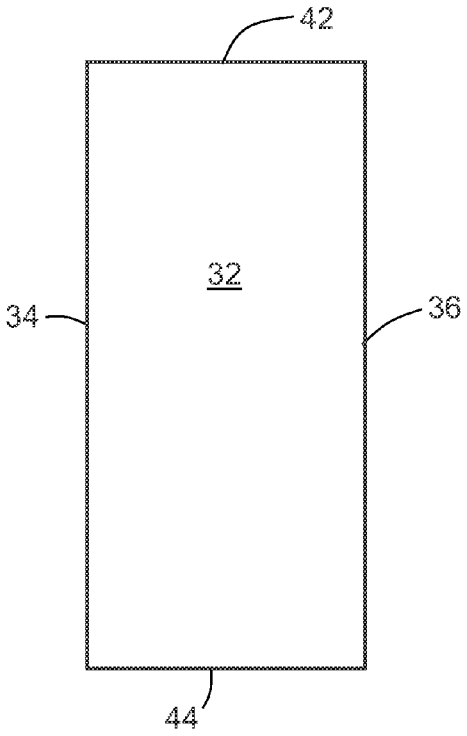
FIGS. 2*a* to 2*c* are top plan views and a perspective view, respectively, of a loop forming part of the infant carrier of FIG. 1, at various stages of construction.
Figure 2B:
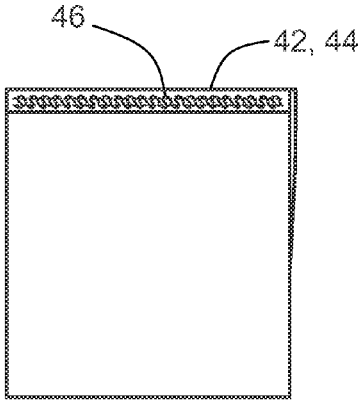
Figure 2C:
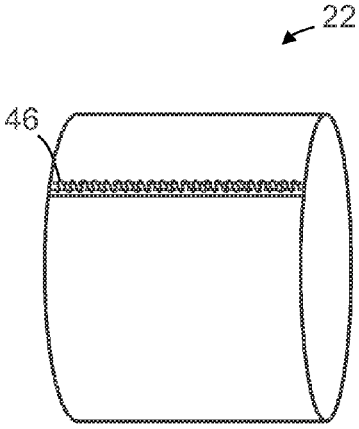
Figure 3:
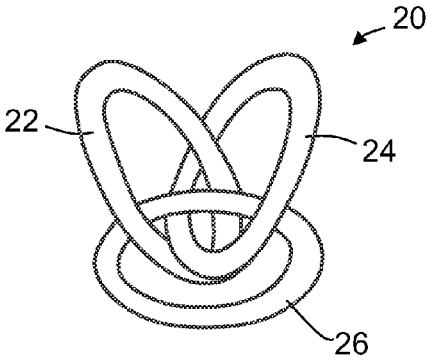
FIG. 3 is a schematic view of the infant carrier of FIG. 1.

FIGS. 2*a* to 2*c* show one of the loops at various stages of construction. Each loop 22, 24 or 26 is fabricated from a rectangular piece 32 of fabric. In this embodiment, the fabric is a knit fabric, and is configured to be stretchable in two (2) directions. As will be understood by those skilled in the art, knit fabric generally has some amount of elasticity, and thereby provides at least some amount of stretchability. Those skilled in the art will also understand that an example of mildly stretchable knit fabric is organic cotton, while an example of moderately stretchable knit fabric is jersey knit. Each piece 32 has longitudinal edges 34 and 36, and transverse edges 42 and 44. In this embodiment, the piece 32 used to fabricate the first and second loops 22 and 24 has a length of about fifty-two (52) inches and a width of about twenty-two (22) inches, while the piece 32 used to fabricate the third loop 26 has a length of about forty-two (42) inches and a width of about twenty-two (22) inches. During construction of each loop 22, 24 or 26, the rectangular piece 32 is folded so as to overlap the transverse edges 42 and 44. The overlapping transverse edges 42 and 44 are then double-stitched so as to form a high-strength transverse seam 46, as shown in FIGS. 2*b* and 2*c*. In this embodiment, the transverse seam 46 is formed by safety-stitching the transverse edges 42 and 44, and then folding back the stitched transverse edges 42 and 44 and stitching an additional flat-lock stitch to increase the strength and comfort of the transverse seam 46. Each of the first, second and third loops 22, 24 and 26 is constructed in the manner described above, and in an interlocking manner with respect to each other, so as to form the infant carrier 20.

In use, a wearer W dons the infant carrier 20 by inserting the third loop 26 around his or her waist. The wearer W may then adjust the length of the third loop 26 to size around his or her waist, as necessary, by twisting the first and second loops 22 and 24 about their connection to the third loop 26. The wearer W then inserts each of his or her arms through a respective one of the first and second loops 22 and 24. Once donned, the first and second loops 22 and 24 are positioned so as to form a cross at the back of the wearer W, as may be seen in FIG. 6.

The lengths of the first and second loops 22 and 24 may be adjusted to size on the wearer W by twisting one or more of the first and second loops 22 and 24, as necessary. Such twisting results in the formation of twists along the one or more twisted loops 22 and 24, which may be worked manually along the length of the loop to the back of the wearer W and adjacent the cross.

Once the infant carrier 20 has been donned by the wearer W, and adjusted to size as necessary, an infant N may then be inserted into the infant carrier 20, and in particular between the first, second and third loops 22, 24 and 26 and the torso of the wearer W. During insertion of the infant N into the infant carrier 20, the first, second and third loops 22, 24 and 26 stretch and gently tighten against the wearer W and around the infant N, so as to securely support the infant N while distributing the weight of the infant N across the shoulders and back of the wearer W. The infant carrier 20 may then be adjusted to size on the wearer W by twisting, or untwisting if already twisted, one or more of the first and second loops 22 and 24, as necessary. The first, second and third loops 22, 24 and 26 may then be unraveled or "spread open", as necessary, so as to provide broader surfaces for supporting the infant N and for distributing its weight over a larger area of the wearer W.

Figure 5:
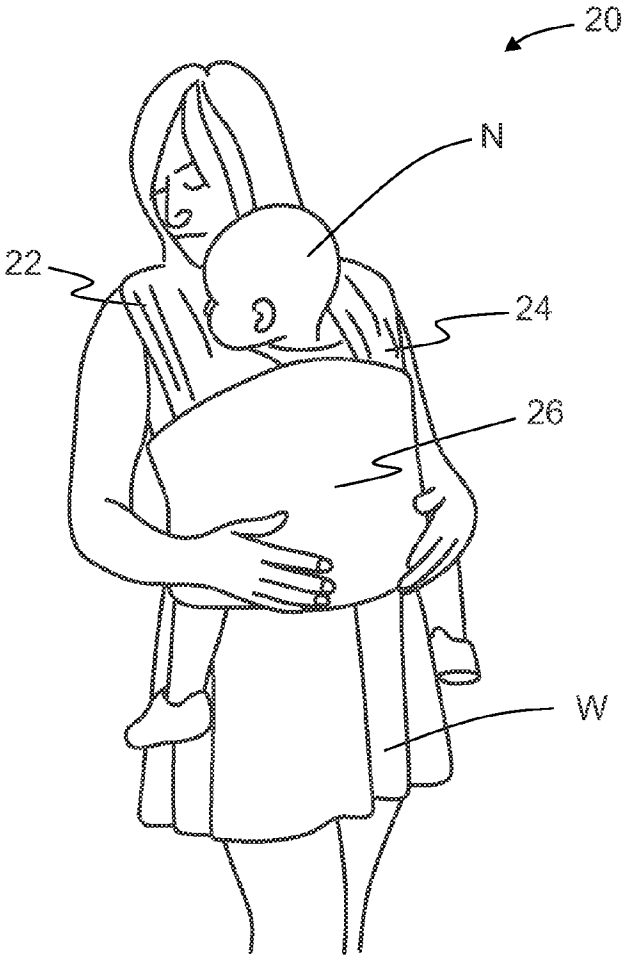
FIGS. 5 and 6 are rear and front views, respectively, of the infant carrier of FIG. 1, worn by the wearer and supporting an infant in an inward-facing position.
Figure 4:
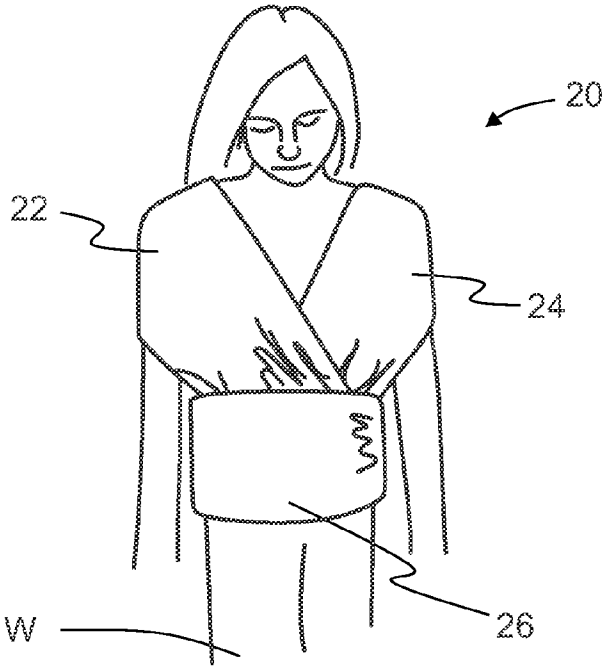
FIG. 4 is a front view of the infant carrier of FIG. 1, worn by a wearer.
Figure 6:
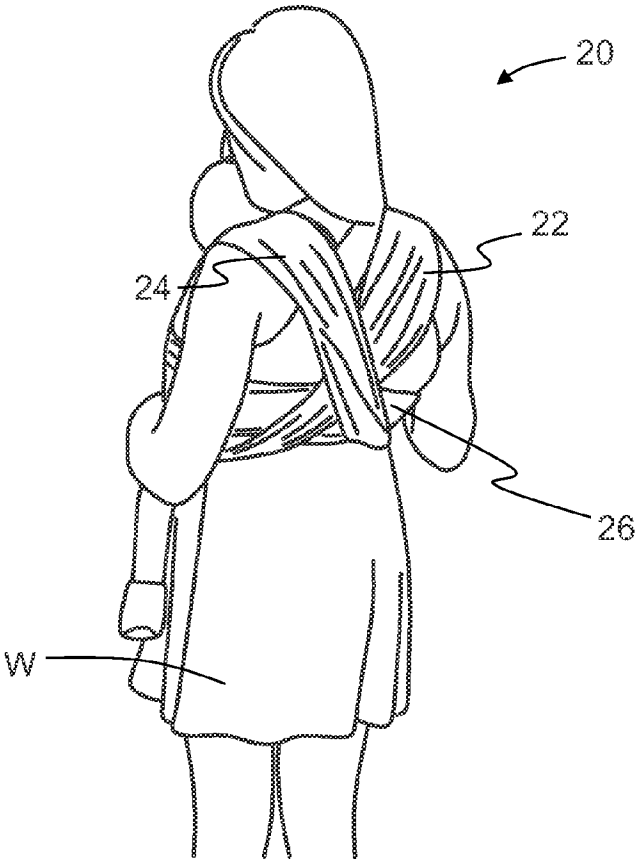

The infant carrier 20 can support the infant in a variety of different positions. For example, FIGS. 5 and 6 show the infant N supported by the infant carrier 20 in an inward-facing position, in which the infant N generally faces the front torso of the wearer W. One or more limbs of the infant N may be fed through gaps formed between the first, second and third loops 22, 24 and 26 and the wearer W, as shown in FIG. 5, so as to allow the infant N to more freely move these limbs. As will be understood, the first, second and third loops 22, 24 and 26 cooperate to effectively provide a five-point harness for the infant N, whereby the first and second loops 22 and 24 extend from the shoulders of the wearer W over the back of the infant N, and then overlap at least partially to each extend under the infant N, while the third loop 26 generally extends from both sides of the waist of the wearer W across the back of the infant N. As a result, the infant N is safely and securely supported by the infant carrier 20.

As will be appreciated, in the inward-facing position, the infant N is supported by the infant carrier 20 in an ergonomically correct manner, whereby the hips and legs of the infant N are kept in an ergonomically desirable "M" position, such that the knees of the infant N are bent and are positioned generally higher than the hips of the infant. The infant carrier 20 also provides excellent support for the developing spine of the infant N.

Figure 7:
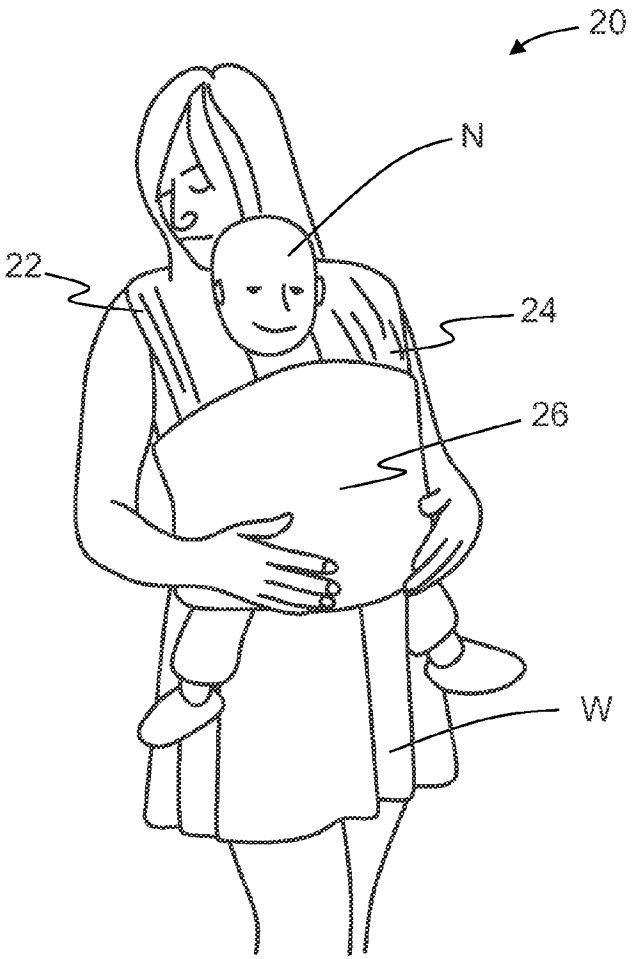
FIG. 7 is a front view of the infant carrier of FIG. 1, worn by the wearer and supporting the infant in an outward-facing position.

The infant carrier 20 can support the infant in other positions. For example, FIG. 7 shows the infant N supported by the infant carrier 20 in an outward-facing position, in which the back of the infant N generally faces the front torso of the wearer W. As with the inward-facing position described above and with reference to FIGS. 5 and 6, one or more limbs of the infant N may be fed through gaps formed between the first, second and third loops 22, 24 and 26 and the wearer W, as shown in FIG. 7, so as to allow the infant N to more freely move these limbs. Additionally, as with the inward-facing position described above and with reference to FIGS. 5 and 6, the first, second and third loops 22, 24 and 26 cooperate to effectively provide a five-point harness for the infant N, whereby the first and second loops 22 and 24 extend from the shoulders of the wearer W over the front of the infant N, and then overlap at least partially to extend under the infant N, while the third loop 26 generally extends from both sides of the waist of the wearer W across the front of the infant N.

Figure 8:
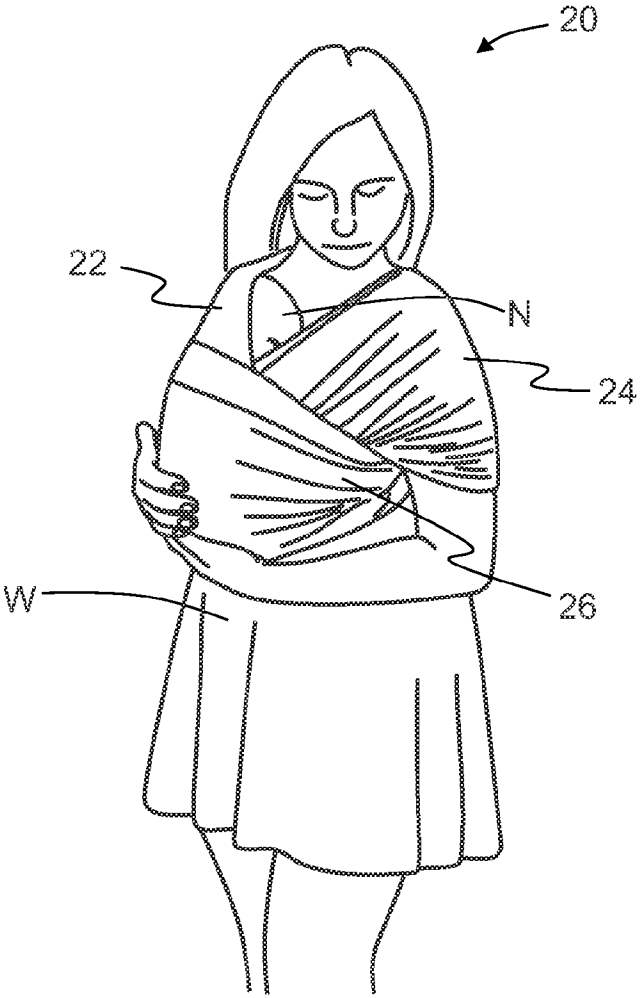
FIG. 8 is a front view of the infant carrier of FIG. 1, worn by the wearer and supporting the infant in a cradle position.

FIG. 8 shows an infant N supported by the infant carrier 20 in a cradle position, which is suitable for infants of small size, such as for example very young babies. In this position, the front of the infant N is held against the front torso of the wearer W, as with the inward-facing position described above and with reference to FIGS. 5 and 6. Additionally, as may be seen, the limbs of the infant N are held within the first, second and third loops 22, 24 and 26, so as to provide support for the limbs. As will be understood, the cradle position facilitates nursing.

Figure 9:
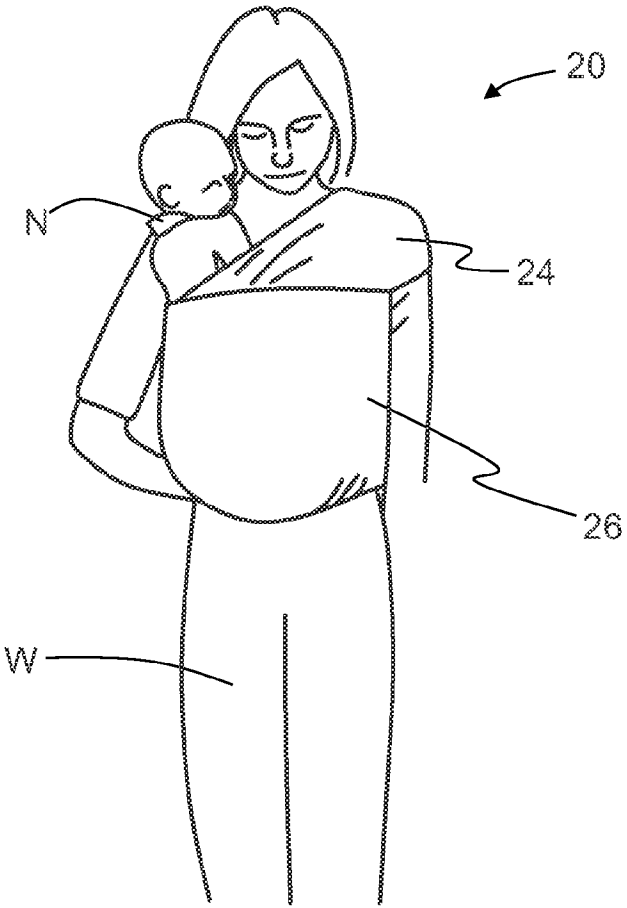
FIG. 9 is a front view of the infant carrier of FIG. 1, worn by the wearer and supporting the infant in a hip-supported position.

FIG. 9 shows an infant N supported by the infant carrier 20 in a hip support position, in which the front of the infant N is held against a side of the torso of the wearer W. The infant carrier 20 may be adjusted to the hip support position by shifting the infant N and infant carrier 20 around the torso of the wearer W from the inward-facing position, and such that the infant N is positioned generally above a hip of the wearer W. As will be appreciated, the hip support position is suitable for infants of large size, such as for example small children, as in this position a portion of the weight of the infant N is transferred onto the hip of the wearer W. Although not shown in FIG. 9, the limbs of the infant N may be fed through gaps formed between the first, second and third loops 22, 24 and 26 and the wearer W, as desired, and as with the inward-facing position described above and with reference to FIGS. 5 and 6. Additionally, and as with the inward-facing position described above and with reference to FIGS. 5 and 6, the first, second and third loops 22, 24 and 26 cooperate to effectively provide a five-point harness for the infant N.

As will be appreciated, the infant carrier 20 is fabricated entirely of fabric, which advantageously provides a soft and comfortable support for the infant, while providing a safe and secure five-point harness for the infant. Also, as the infant carrier 20 is fabricated entirely of fabric, the infant carrier may 20 be easily cleaned by machine washing and drying. Additionally, and as will be appreciated, as the infant carrier

20 is fabricated entirely of fabric, it may be easily folded into a compact volume for storage, such as for example in a diaper bag.

Advantageously, and as will be understood, a single individual wearer may easily don the infant carrier 20 while holding an infant, and may easily insert the infant therein once donned, by himself or herself alone and by using only two (2) hands. The wearer is advantageously not required to wrap, tie, fasten or buckle the infant carrier to their person in any way prior to, or during, use.

As will be appreciated, the infant carrier 20 advantageously does not comprise any fasteners, such as for example buckles, straps, rings, clips, and the like. As will be understood, such fasteners can break, which can result in failure of the conventional infant carrier during use. Moreover, such fasteners of conventional infant carriers are typically not replaceable and, in the event that one or more of the fasteners do break, the entire conventional infant carrier typically needs to be replaced.

As the infant carrier 20 may be easily adjusted to size, the infant carrier 20 is versatile and may advantageously accommodate infants of different size, and may also be worn by different individuals of different size. As will be appreciated, this allows the same infant carrier 20 to be worn over the course of the infant's entire early life, and by both the mother and the father, for example.

As will be appreciated, the infant carrier 20 is versatile, and advantageously may be used to support an infant in a variety of different positions. However, to avoid undue stress on the body of the infant, it is not recommended to support the infant in either the outward-facing position or the cradle position for long periods of time.

In other embodiments, the infant carrier may alternatively have one or more pockets formed on one or more of the first, second and third loops.

Although in the embodiment described above, the first and second loops have the same circumferential length, and the third loop has a shorter circumferential length than each of the first and second loops, in other embodiments, the first, second and third loops may alternatively have the same circumferential length. In still other embodiments, each of the first, second and third loops may alternatively have different circumferential lengths.

Although in the embodiment described above, the transverse seam is formed by safety-stitching the transverse edges and then folding back the stitched transverse edges and stitching an additional flat-lock stitch to increase the strength and comfort of the transverse seam, in other embodiments, the transverse seam may alternatively be formed by one or more other stitching techniques.

It will be understood that the pieces of fabric used to fabricate the first, second and third loops are not limited to the dimensions described above, and in other embodiments the pieces of fabric may alternatively have different dimensions. It will also be understood that the pieces of fabric need not be limited to a rectangular shape, and in other embodiments may alternatively have another shape. Additionally, it will be understood that at least one of the first loop, the second loop, and the third loop may alternatively be fabricated from two (2) or more pieces of fabric stitched together to effectively form a single piece.

Although embodiments have been described above and with reference to the accompanying drawings, those of skill in the art will appreciate that variations and modifications may be made without departing from the scope thereof as defined by the appended claims.

What is claimed is:

1. An infant carrier comprising:

three interconnected loops of fabric, the three interconnected loops comprising a first loop, a second loop and a third loop, the first and second loops each being configured for being worn over a respective shoulder of a wearer, the third loop being configured for being worn about the waist of the wearer, the first, second and third loops cooperating to support an infant when worn by the wearer.

2. The infant carrier of claim 1, wherein the infant carrier is fabricated entirely of the fabric.

3. The infant carrier of claim 1, wherein the infant carrier is devoid of any fastener.

4. The infant carrier of claim 1, wherein the third loop is shorter in length than the first loop and the second loop.

5. The infant carrier of claim 1, wherein at least one of the loops is fabricated from a rectangular piece of the fabric having stitched transverse edges.

6. The infant carrier of claim 1, further comprising at least one pocket on one or more of the first, second and third loops.

7. The infant carrier of claim 1, wherein the first, second and third loops cooperate to provide a five-point harness for supporting the infant when worn by the wearer.

8. The infant carrier of claim 1, wherein the infant carrier is adjustable to size by twisting one or more of the first, second and third loops.

9. The infant carrier of claim 1, wherein each of the three interconnected loops is connected to each of the other two loops in an interlocking manner.

10. The infant carrier of claim 1, wherein the fabric is a knit fabric.

* * * * *